US007481643B2

(12) United States Patent
Catelli

(10) Patent No.: US 7,481,643 B2
(45) Date of Patent: Jan. 27, 2009

(54) CONVERTIBLE EMBOSSING DEVICE

(75) Inventor: Paolo Catelli, Lucca (IT)

(73) Assignee: FUTURA S.p.A., Capannori (LU), Frazione Guamo (IT)

( * ) Notice: Subject to any disclaimer, the term of this patent is extended or adjusted under 35 U.S.C. 154(b) by 337 days.

(21) Appl. No.: 10/595,812

(22) PCT Filed: Apr. 19, 2005

(86) PCT No.: PCT/IT2005/000223

§ 371 (c)(1),
(2), (4) Date: May 12, 2006

(87) PCT Pub. No.: WO2006/027809

PCT Pub. Date: Mar. 16, 2006

(65) Prior Publication Data

US 2007/0000615 A1 Jan. 4, 2007

(30) Foreign Application Priority Data

Sep. 10, 2004 (IT) ..... PT04A0011

(51) Int. Cl.
*B31F 1/07* (2006.01)

(52) U.S. Cl. ..... 425/181; 101/6; 156/582; 162/362; 425/183; 425/188; 425/194; 425/363

(58) Field of Classification Search ..... 425/183, 425/188, 194, 181, 363; 101/6; 156/553, 156/555, 582; 162/362
See application file for complete search history.

(56) References Cited

U.S. PATENT DOCUMENTS 1,939,362 A * 12/1933 Patt ..... 425/194
5,064,584 A * 11/1991 Jefferies ..... 425/194
6,176,287 B1 * 1/2001 Weber ..... 156/555
6,261,666 B1 * 7/2001 Enderby et al. ..... 428/172
6,470,945 B1 * 10/2002 Biagiotti ..... 156/553

* cited by examiner

*Primary Examiner*—James Mackey
(74) *Attorney, Agent, or Firm*—McGlew & Tuttle, P.C.

(57) ABSTRACT

Convertible embossing device comprising a structure (1) with two fixed sides (10) and two mobile sides (11) with respective external faces (EF, EM) and internal faces (IF, IM) and provided with, in correspondence of the respective internal faces (IF, IM), two upper recesses (12, 13) and two lower recesses (12', 13') with a circle-arc profile intended to support the end flanges (20, 30) of the two embossing rolls (2, 3) orthogonal to the sides (10, 11) of the same structure (1), wherein the mobile sides (11) are joined to the fixed sides (10) and the respective upper and lower recesses (12, 13, 12', 13') define, by cooperating with one another, two pairs of circular seats for the flanges (20, 30) of the rolls (2, 3), and in that, in a second operating position, the mobile sides (11) are distanced from the fixed sides (10) and the upper recesses (12, 13) of the sides (10) and (11) define, each one by cooperating with corresponding semi-circular closure flanges (15, 16), two pairs of circular seats for the flanges (20, 30) of the rolls (2, 3).

8 Claims, 7 Drawing Sheets

CONVERTIBLE EMBOSSING DEVICE

The present invention relates to a convertible embossing device. Embossing devices are known from U.S. Pat. No. 6,176,287, WO 2004/002727, EP980750 and WO 99/41064.

It is known that embossing consists in a mechanical procedure to impart multiple patterns onto yielding materials, for example onto webs or "plies" of paper. To this end, the material to be embossed is moved through an embossing calender consisting of a pair of counter-rotating steel rolls exhibiting substantially punctiform protuberances and of a pair of corresponding pressure rolls. In the so-called "nested" type of embossing, during manufacturing, the protuberances on a roll of the calendar correspond with the recessions defined by the protuberances on the other roll. In the case of the so-called "tip-to-tip" type of embossing, during manufacturing, the protuberances on a roll always correspond with the protuberances on the other roll. In order to change from one type of embossing to the other, it is necessary, each time, to stop the manufacturing and reconfigure the device by disassembling some parts and take care of replacing the disassembled parts with others of appropriate size and configuration for the specific task at hand. An inconvenience lies in that the time necessary to reconfigure the device is elevated, that is incompatible with nowadays production standards. Moreover, it is necessary to have available two conversion kits and the space needed for the removal of one of the kits while the other one is being used.

The main objective of the present invention is to solve the above inconveniences.

This result has been achieved, according to the present invention, by adopting the idea of creating a device having the characteristics disclosed in claim 1. Further characteristics of the invention are dealt with in the dependent claims.

Thanks to the present invention it is possible to drastically reduce the number of operations necessary to change from the "nested" type of embossing to the "tip-to-tip" type, and vice versa, always using the same device. Likewise, the time necessary to reconfigure the device every time the need arises to change from one type of manufacturing to the other is also reduced. Additionally, a convertible embossing device according to the present invention is relatively easy to make, cost-effective and reliable even after extensive use.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
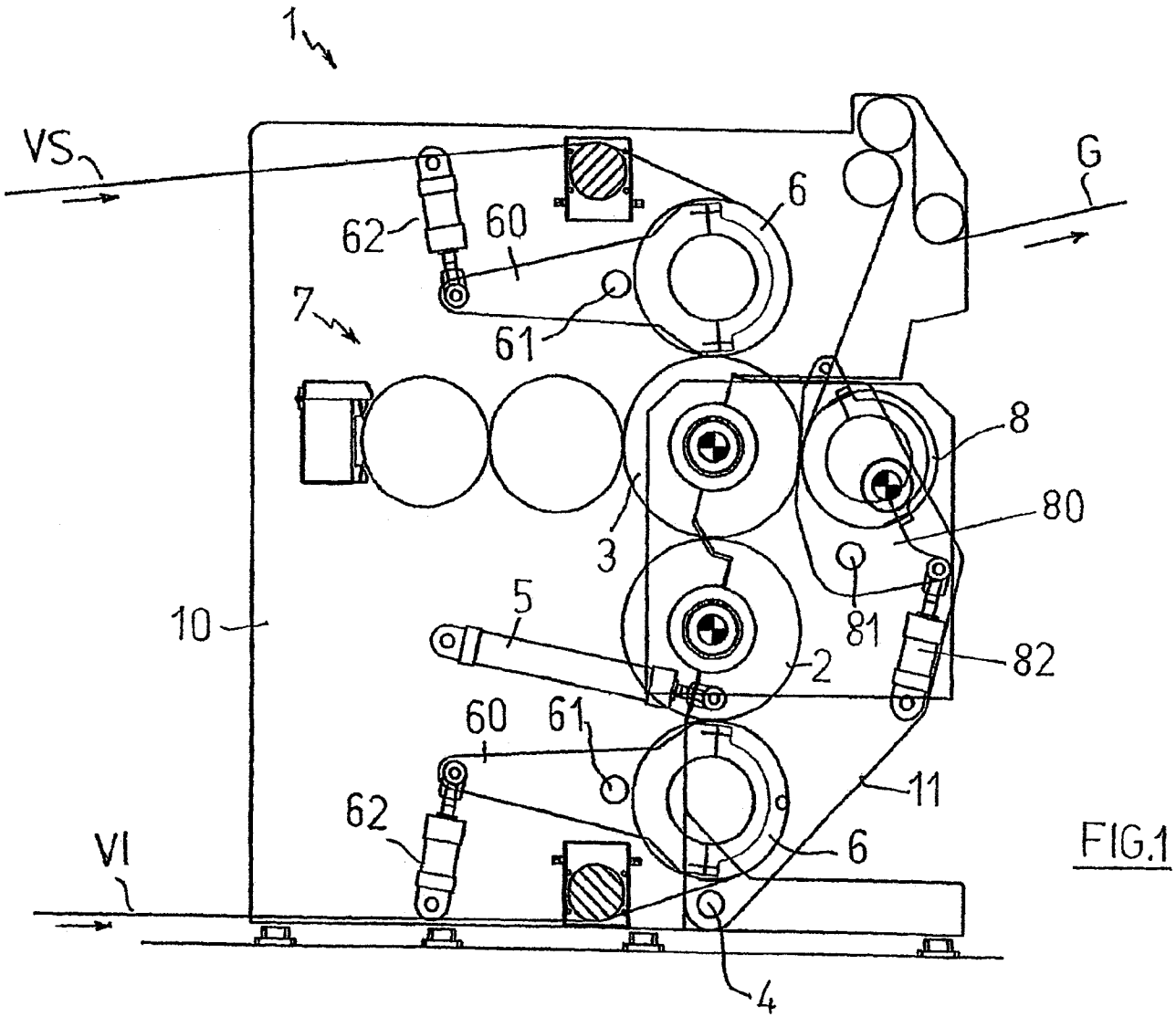
FIG. 1 is a schematic lateral transparency view of a convertible embossing device according to the present invention in a "nested" embossing position.

Reduced to its basic structure and with reference being made to the figures in the attached drawings, a convertible embossing device according to the present invention comprises a structure (1) with two fixed sides (10), to which two mobile sides (11) are hinged. Each of said fixed sides (10) exhibits an external face (EF) and an internal face (IF), the latter facing towards the corresponding mobile side (11). Analogously, each of said mobile sides (11) exhibits an external face (EM) and an internal face (IM), the latter facing the respective fixed side (10). The internal face (IF) of each fixed side (10) exhibits two circle-arc recesses (12, 12'), one (12) positioned further up and the other one (12') positioned further down. The internal face (IM) of each mobile side (11) exhibits two analogous recesses (13, 13'), also with a circle-arc profile. As better described in more detail below, said recesses (12, 12', 13, 13') provided in the internal faces (IF, IM) of the sides (10) and (11) function as support seats for the embossing rolls (2, 3). The mobile sides (11) are hinged to the lower base of the fixed sides (10), by means of a pin (4) having the axis orthogonal to the same sides (10, 11). Moreover, the mobile sides (11) are connected to a pair of actuators (5) which makes the mobile sides (11) approach the fixed sides (10), as in FIG. 1 and FIG. 3, and, vice versa, make them move apart, as in FIG. 2 and FIG. 4. In the example shown in the figures in the attached drawings, the skirt of each actuator (5) is hinged to a respective fixed side (10), while the free end of the rod is hinged to the corresponding mobile side (11). When the rod of the actuators (5) is extracted, the mobile sides (11) are distanced from the fixed ones, with the rotation of the mobile sides around the axis of the pin (4). Vice versa, when the rod of the actuators (5) is retracted, the mobile sides (11) approach the fixed sides (10), always with the rotation of the mobile sides around the axis of the pin (4).

The fixed sides (10) support two pressure rolls (6) which are set on opposite sides of said recesses (12, 12'), that is, with reference being made to the diagram in FIG. 1, a pressure roll (6) above the recess (12) and a pressure roll (6) below the recess (12'). In more detail, said pressure rolls are mounted onto corresponding arms (60), each one being anchored to the respective side (10) by means of a pin (61) orthogonal to the side (10) and the respective arm (60). Moreover, each of said arms (60) is connected to a corresponding actuator (62) which controls its rotation around said pin (61). Each of said pressure rolls (6) is mounted onto the front end (end facing the internal face IF of the respective side 10) of the corresponding arm (60), whereas the corresponding actuator (62) intervenes on the rear end (end opposite the one above) of the arm. The skirts of the actuators (62) are hinged to the fixed sides (10), whereas the respective rods are hinged to the rear ends of the arms (60). The pressure rolls (6) associated with the fixed sides (10) cooperate with the embossing rolls (2, 3) when the device is in the position in FIG. 1, that is when the rolls (2, 3) are positioned vertically one on top of the other. With the device being in the position in FIG. 1, each paper ply (vs, VI) intended to become an embossed double ply first goes through the calender formed by one of the pressure rolls (6) and the corresponding embossing roll (2; 3) and then through the two embossing rolls (2, 3). The embossed double ply is indicated with the letter "G".

The fixed sides (10) support a sizing unit (7), per se known to the technicians of the field, set and operating at the height of one of the recesses (12, 12') provided in the internal face of the same sides (in detail, in the example in the attached drawings, at the height of the upper recess 12). Said sizing unit (7) is intended to operate, with procedures known to the technicians of the field, on the embossing roll which, when the device is configured either for the "tip-to-tip" embossing or for the "nested" embossing, is positioned, as further described below, in correspondence with the upper recess (12) of the fixed sides (10). Since the structure and the functioning of the sizing unit (7) are known to the technicians of the field, they are not further described herein.

A third pressure roll (8) is supported by the mobile sides (11). In detail, according to the example in the attached drawings, the third pressure roll (8) is mounted onto a corresponding support (80). The latter, in turn, is made of two parallel plates which are internal to the mobile sides (11) and pivotally joined to the same sides (11) by means of a pin (81) orthogonal to the same sides. Moreover, each of said plates is connected to an actuator (82) which controls its rotation around the axis of said pin (81). The position of the actuator (82) and of the support (80), and therefore of the third pressure roll (8), change according to the configuration of the device. In more detail, when the device is in the configuration as in FIG. 1, the support (80) is positioned so that the pressure roll (8) presses against the upper embossing roll (3); and when the device is in the configuration as in FIG. 3, the support (80) is positioned so that the pressure roll (6) presses against the right side embossing roll (2). To this end, it will suffice to manually reposition the support (80) and the actuator (82), and to mount the lower roll (6) instead of the roll (8) every time it is necessary to change from the position in FIG. 1 to the position in FIG. 3, and vice versa. The actuator (82) ensures that the pressure roll (8), or the roll (6), depending on the desired configuration, exerts a pressure on the embossing roll (3). Multiple corresponding holes are made in the mobile sides (11) and in the support (80) for screw means to fasten the support (80) to the mobile sides (11) in the positions shown in FIG. 1 and respectively in FIG. 3

Each one of the embossing rolls (2, 3) exhibits a circular flange (20, 30) on each end of the respective axis (21, 31). Each of said flanges (20, 30) exhibits a circumferential groove (23, 33). Moreover, in correspondence of one of the ends (the right side end in the diagram in FIG. 5) the axis (21, 31) of each embossing roll (2, 3) is provided with an axial driving head or takeoff (22, 32) by means of which the roll (2, 3) may be driven into rotation around its own axis (21, 31).

Figure 2:
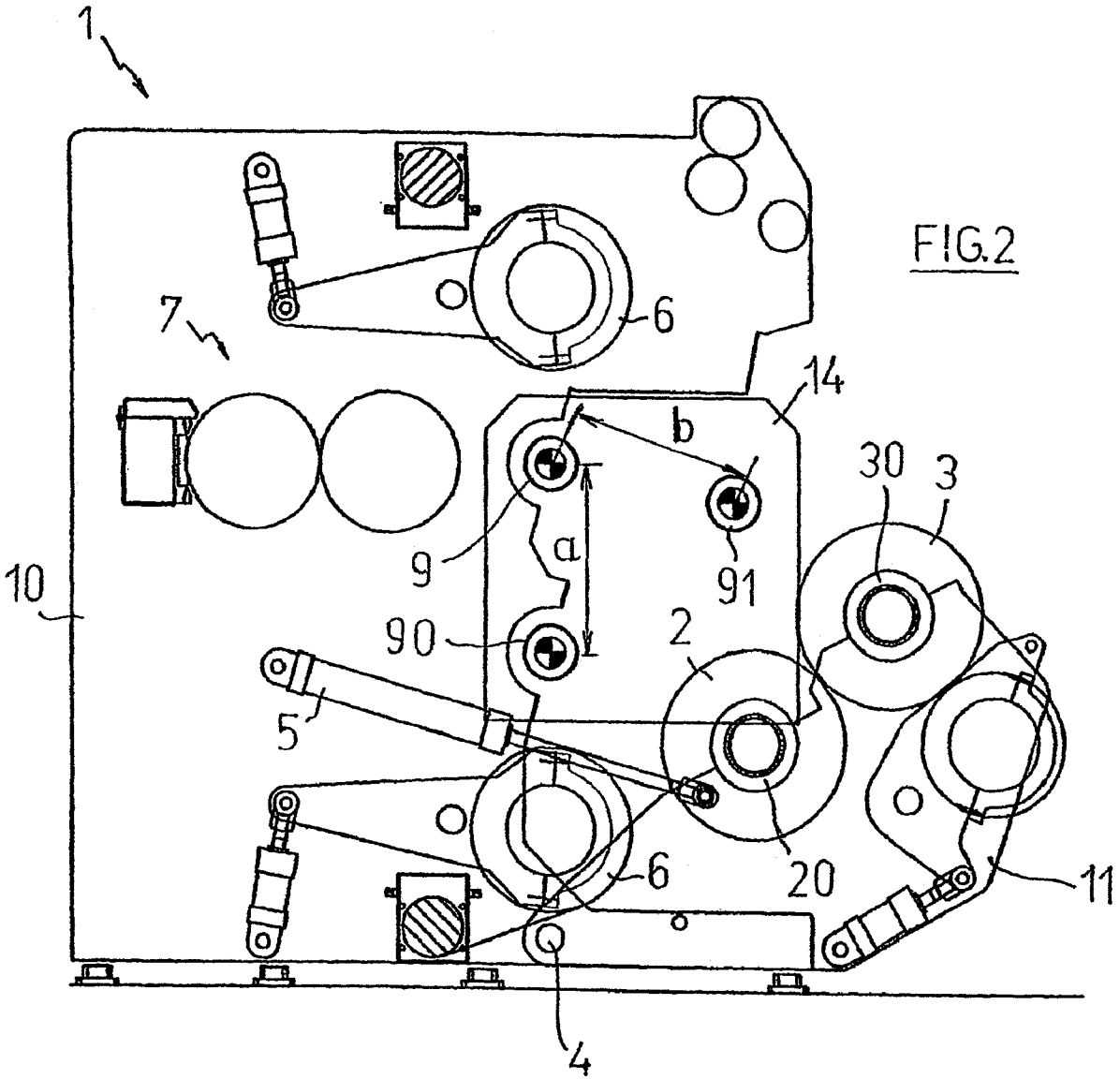
FIG. 2 shows the device in FIG. 1 in the opening position, that is in the position for the possible replacement of the embossing rolls.

The embossing rolls (2, 3) are positioned as shown in FIG. 1 by utilizing the recesses (12, 13, 12', 13') of the sides (10) and (11), so that the same rolls (2, 3) result vertically aligned. In the configuration in FIG. 3, the embossing rolls (2, 3) are positioned utilizing only the upper recess (12, 13) of the fixed sides (10) and respectively of the mobile ones (11). In both cases, the flanges (20, 30) of the embossing rolls (2, 3) are positioned with the respective grooves (23, 33) astride of the selected seats (12, 12', 13, 13'). Both in the "nested" configuration in FIG. 1 and in the "tip-to-tip" configuration in FIG. 3, the upper recesses (12, 13) of the fixed sides (10) and of the mobile ones (11) are used.

This device comprises handling means for the embossing rolls (2, 3) in both the "nested" and the "tip-to-tip" configurations. According to the example shown in the figures of the attached drawings, said handling means of the embossing rolls comprise a triad of horizontal driving shafts (9, 90, 91) set, respectively, in line with the recesses (12, 12') of the fixed sides (10) and with the upper recess (13) of the mobile sides (11). In other words, from a frontal view, the axes of said shafts (9, 90, 91) are positioned according to the vertexes of a triangle, with each vertex corresponding to the center of the arches that define the recesses (12, 12') of the fixed sides (10) and of the arch that defines the upper recess (13) of the mobile side (11) in the "tip-to-tip" position. The positions of the three driving shafts (9, 90, 91) are unequivocally defined, since both the distance (a) between the centers of the arches (12) and (12') and the distance (b) between the centers of the arches (12) and (13) when the device is in the "tip-to-tip" configuration are known and predetermined. Said distances (a, b) are predetermined according to the geometry and nominal dimensions of the embossing rolls (2, 3) intended to be used by the device. Still in other words, the shafts (9) and (91) corresponding to the upper recesses (12, 13) of the sides (10, 11) are positioned at the two ends of an ideal circle-arc which have the center on the axis of the pins (4) fastening the mobile sides to the fixes sides and of which the angular extension is proportional to the geometric characteristics and nominal dimensions, known and predetermined, of the embossing rolls (2, 3).

Said driving shafts (9, 90, 91) are supported by a fixed lateral appendix (14) of the supporting structure (1) and are connected to three corresponding independent electrical motors (not shown) or, alternatively, to only one electrical motor (not shown) by means of a conventional transmission either of the belts and pulleys type or of the gears type.

Figure 5A:
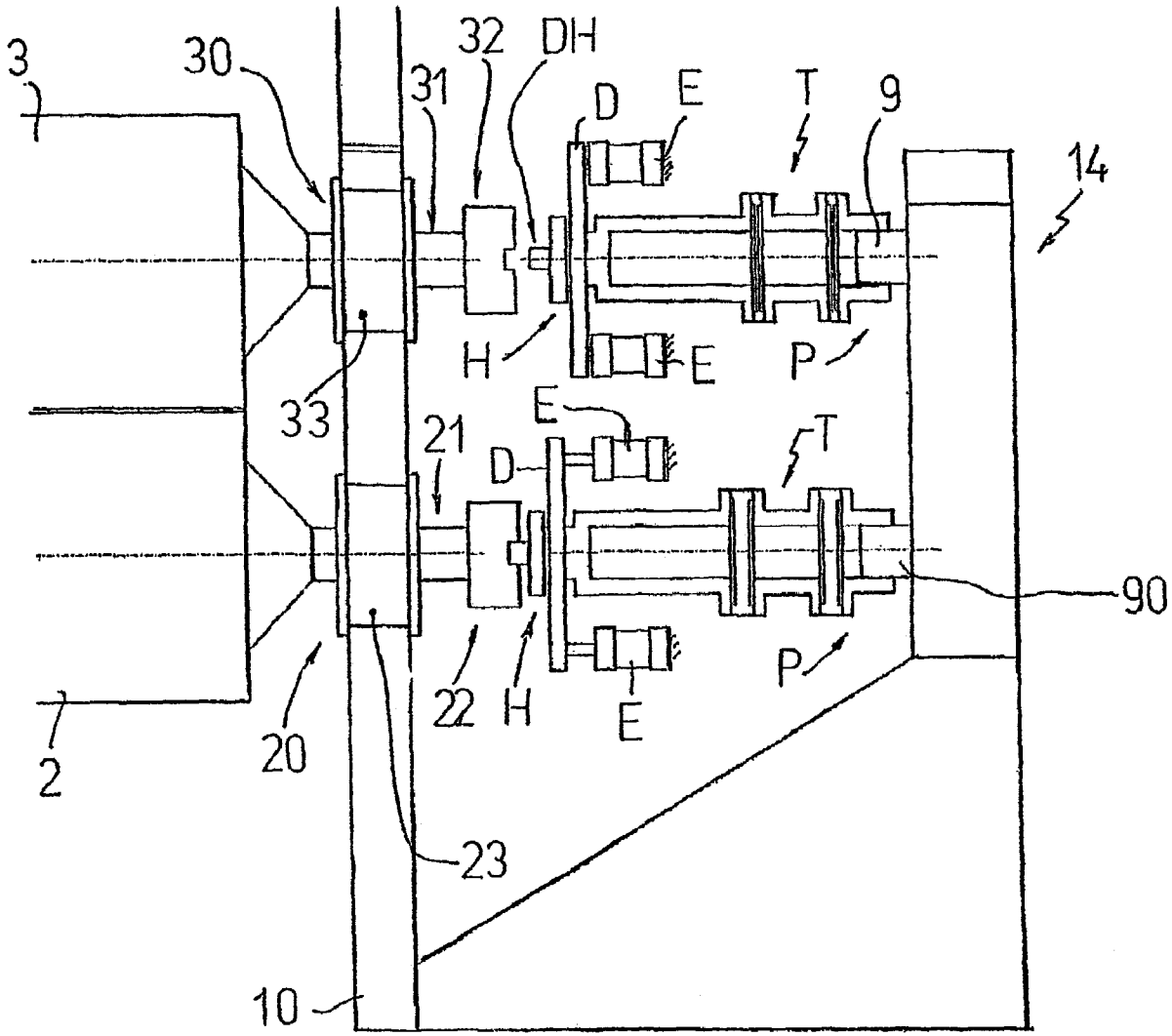
FIG. 5A shows a partial frontal view of a device according to the invention, where a detail of the handling means of the embossing rolls according to a possible embodiment of the device is visible.
Figure 5B:
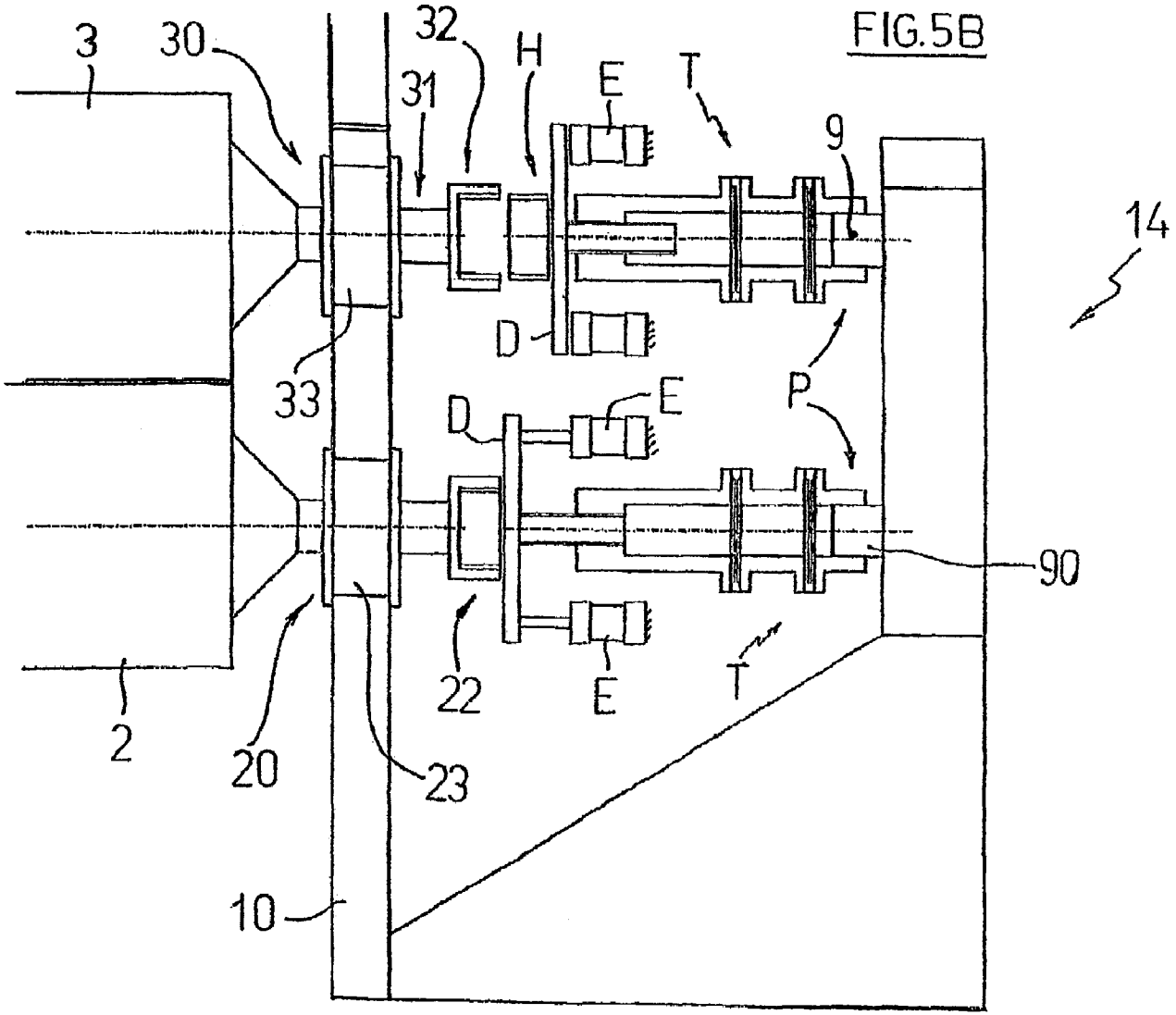
FIG. 5B shows, the same way as in FIG. 5A, a detail of the handling means of the embossing rolls, according to a further possible embodiment.
Figure 6:
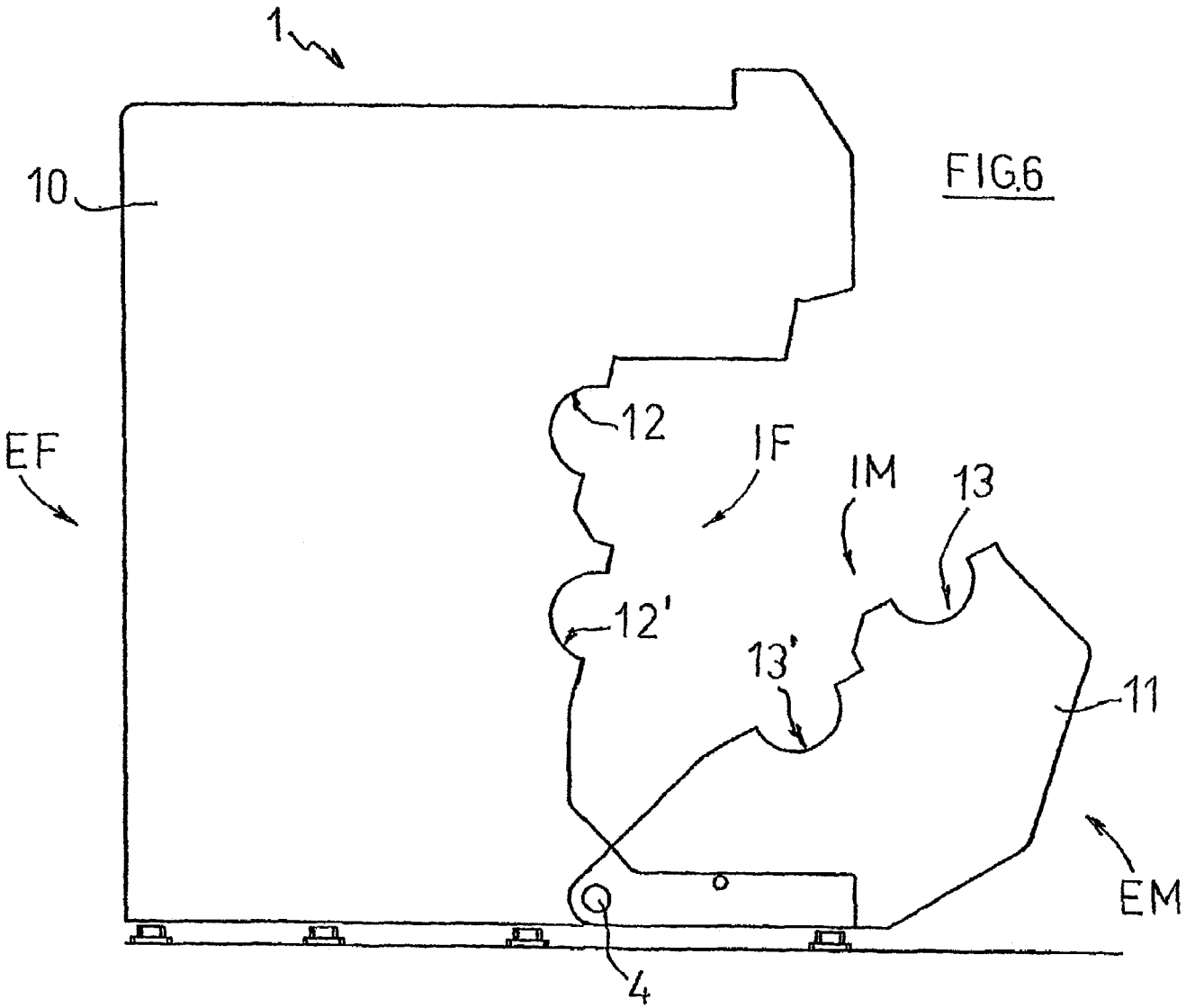
FIG. 6 shows a schematic lateral transparency view of the structure (1).

Each one of said shafts (9, 90, 91) may be connected to the respective roll (2, 3) by means of a laminar joint (T) which, as known, allows to compensate for eventual faulty alignments between the axes of the same shafts and the axes of the rolls (2, 3). The rear portion (P) of each of said joints (T) is directly connected to the respective shaft (9, 90, 91) whereas the front portion (H) is appropriately shaped in order to engage, as described below in more detail, the power takeoff (22, 32) of the respective embossing roll (2, 3). The examples in FIGS. 5A and 5B differ from one another precisely in that the shape of the front portions (H) of the joints (T) and the shape of the front portion of the power takeoffs (22, 32) of the rolls (2, 3) are different. In the case of FIG. 5A, the front end (H) of the joint (T) is provided with a central wedge-shaped tooth (DH) and the lateral power takeoff (22, 32) of the rolls (2, 3) exhibits a central slot (cc) of the corresponding shape. In the case of FIG. 5B, the front end (H) of the joint (T) is made of a grooved bar, able to axially slide inside the joint and provided with external toothing, and the lateral power takeoff (22, 32) of the rolls (2, 3) is cup-shaped and is provided with corresponding internal toothing. In order to make the front portion of the joints (T) approach the power takeoffs (22, 32) of the rolls (2, 3), a plate (D), which connected with two actuators (E) supported by the fixed part of the structure (1), is fixed to the front portion (H) of the joints (T), having interposed a bearing not visible in the drawings. When the rods of the actuators (E) are extracted, the front portion (H) of the joints (T) engages the power takeoff (22, 32) of the corresponding roll (2, 3); vice versa, when the rods of the actuators (E) are retracted, said power takeoffs are disengaged- and the rolls (2, 3) are free. As an example, in FIGS. 5A and 5B, the upper roll (3) is free, whereas the power takeoff (22) of the lower roll (2) is engaged by the front portion (H) of the relative joint (T). In the same diagrams, for graphic simplicity, the third shaft is not shown (91).

As may be gleaned from the figures in the attached drawings, the axes of the embossing rolls (2, 3), of the driving shafts (9, 90, 91), of the pressure rolls (6, 8) and of the pins where the supports (60, 80) of the pressure rolls are pivoted, are parallel to each other and orthogonal to the fixed sides (10) and the mobile ones (11).

In order to operate the device in the "nested" configuration, that is in order to arrange it as in FIG. 1, the embossing rolls are positioned with the respective flanges (20, 30) in the seats (13, 13') of the mobile sides (11), then the command for the retraction of the rod of the actuator (5) must be imparted in order to make the mobile sides (11) rotate around the pins (4) and make them approach the fixed sides (10). At the end of such rotation, the flanges (20, 30) of the roll (2; 3) are in the recesses (12'; 12) of the fixed sides (10) and in the recesses (13'; 13) of the mobile sides. The traction exerted by the actuators (5) is sufficient to maintain this configuration of the device even during the operating phase. The support (80) of the pressure roll (8) is arranged as in FIG. 1, so that the pressure roll (8) is in contact with the upper roll (3) on the diametrically opposite side of the sizing unit (7). In order to move the rolls (2, 3) only the shafts (9) and (9o) are used whereas the shaft (91) is not used.

Figure 3:
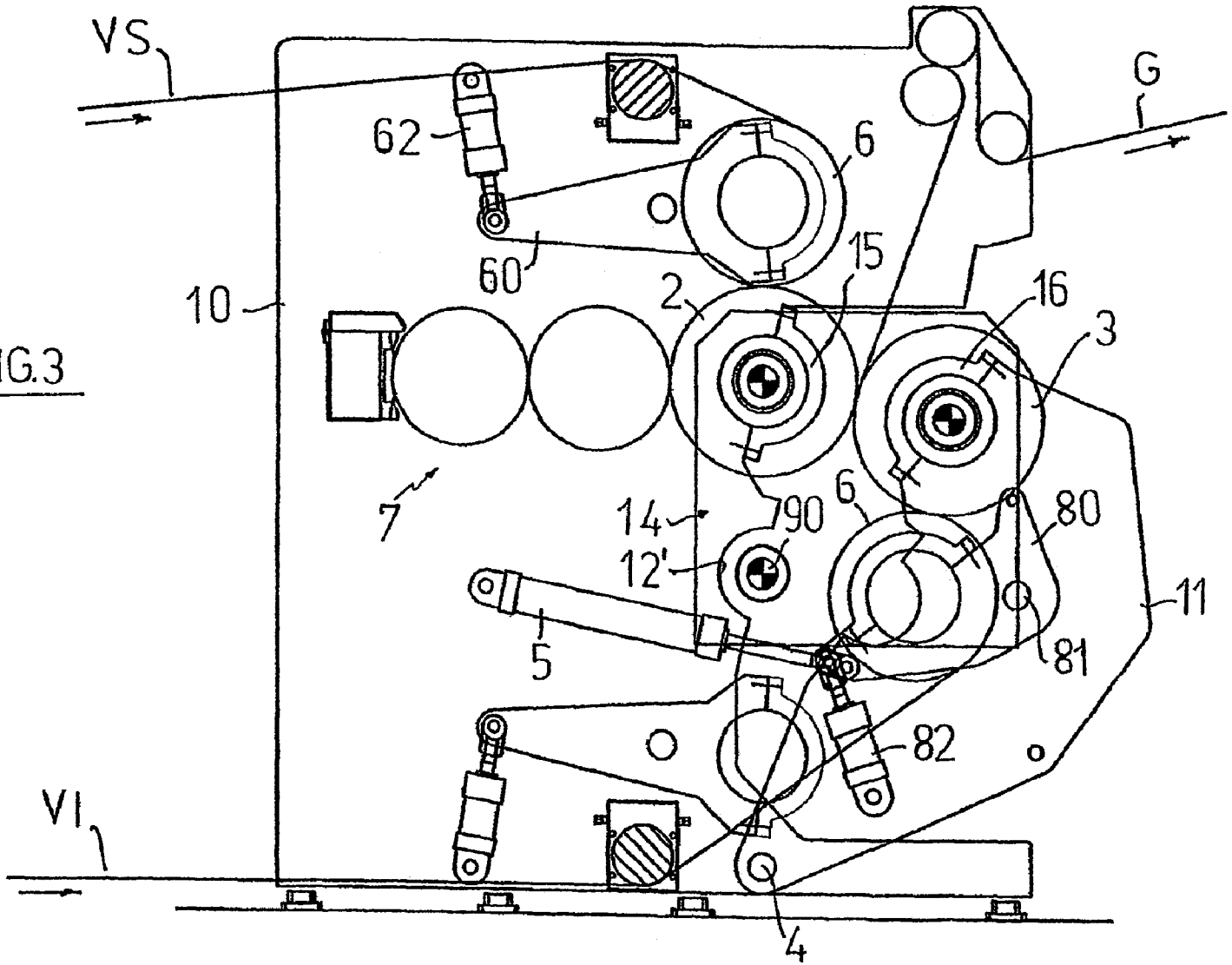
FIG. 3 is a schematic lateral transparency view of a convertible embossing device according to the present invention in a "tip-to-tip" embossing position.
Figure 4:
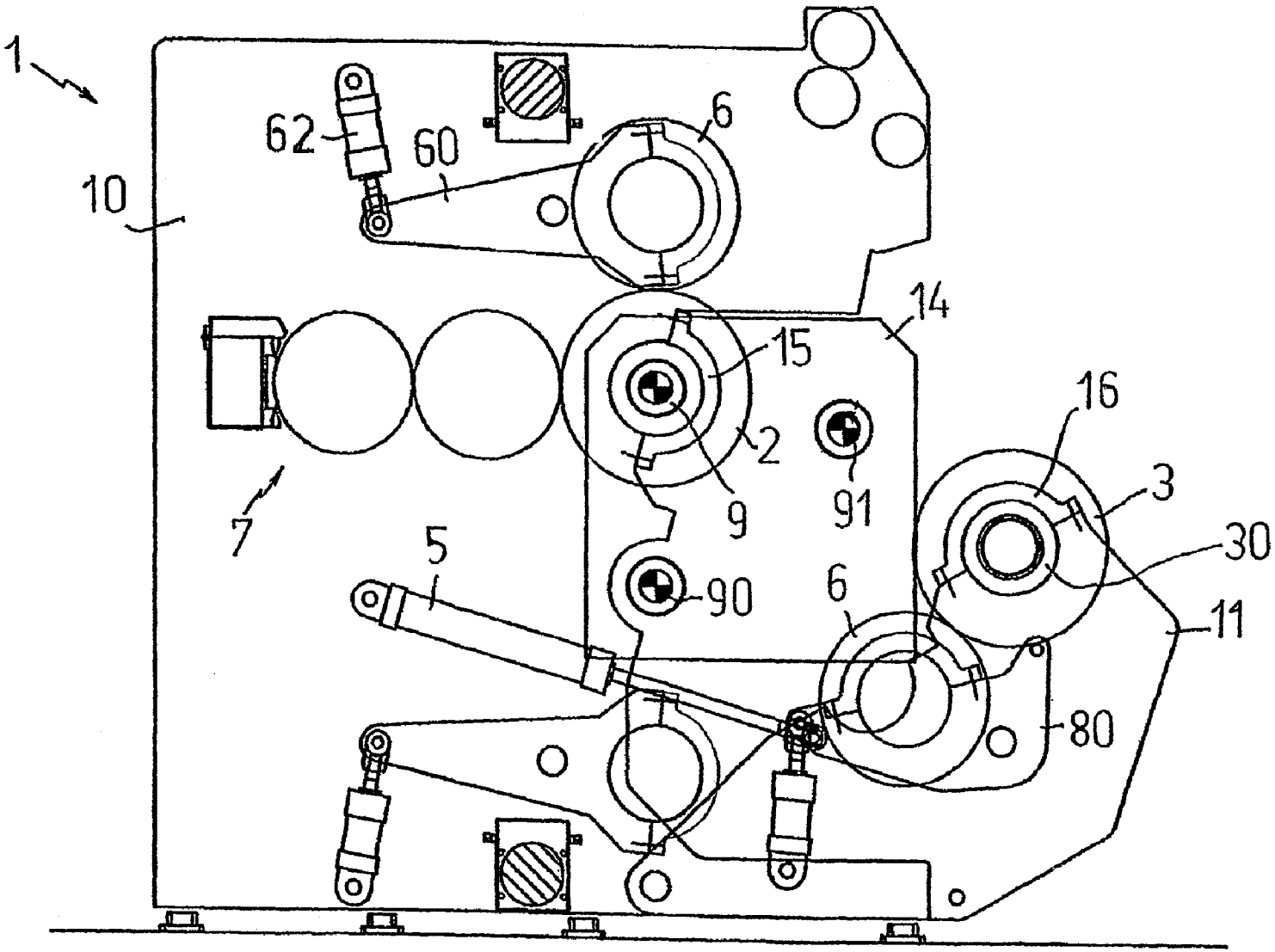
FIG. 4 shows the device in FIG. 3 in the opening position, that is in the position for the possible replacement of the embossing rolls.

In order to operate the device in the "tip-to-tip" configuration, that is in order to arrange it as in FIG. 3, the flanges (30) of the roll (3) are positioned in the upper recesses (13) of the mobile sides (11), whereas the flanges (20) of the roll (2) are in the upper recesses (12) of the fixed sides (10). A semi-circular closure flange (15, 16) is connected by screw means in correspondence of each of said recesses. Even in this case, the traction exerted by the actuators (5) on the mobile sides (11) is sufficient to ensure the necessary pressure between the embossing rolls (2, 3). When the device is in this configuration, the support (80) of the pressure roll (6) is positioned so that the pressure roll comes into contact from below with the roll (3). In order to move the rolls (2, 3), the shafts (9) and (91) are used, whereas the shaft (90) is not in use.

Practically, in the operating position in FIG. 1, the mobile sides (11) are approached to the fixed sides (10) and the respective upper and lower recesses (12, 13, 12', 13') define, by cooperating with one another, the (closed circular) seats of the flanges (20, 30) of the ends of the rolls (2, 3). There are four of said seats, that is two for each roll (2, 3), though only-two are visible in FIG. 1, since this is a lateral view of the device. In the operating position in FIG. 3, the mobile sides (11) are distanced from the fixed sides (10) and the upper recesses (12, 13) of said sides (10, 11) define, each one by cooperating with a corresponding semi-circular flange or "hat" (15, 16), the (closed circular) seats of the flanges of the ends (20, 30) of the rolls (2, 3). Even in this case, there are four of said seats though only two are visible in FIG. 3, since this is a lateral view of the device.

The above mentioned mechanism for the engagement/disengagement the power takeoffs (22, 32) of the rolls (2, 3) in relation to the joints (T) constitutes, in practice, a selector capable of setting only two driving shafts at the time in the position of engagement with the embossing rolls (2, 3).

The above description clarifies how a convertible embossing device, according to the present invention, allows to easily and quickly change from one type of embossing to another, without having to replace every time the seat for the embossing rolls.

Practically, the construction details may vary in any equivalent way as far as the shape, dimension, disposition of elements and materials used are concerned, without nevertheless departing from the scope of the adopted solution idea and, thereby, remaining within the limits of protection granted to the present patent for industrial invention.

The invention claimed is:

1. A convertible embossing device comprising:

a structure with two fixed sides and two mobile sides, each of said two fixed sides having an external fixed side face and an internal fixed side face, said internal fixed side face having an upper fixed side face recess with a circular arc profile and a lower fixed side face recess with a circular arc profile, each of said two mobile sides having an external mobile side face and an internal mobile side face, said internal mobile side face having an upper mobile side face recess with a circular arc profile and a lower mobile side face recess with a circular arc profile;

a handling means for moving said mobile sides from a first operating position to a second operation position, wherein the mobile sides are joined to the fixed sides and connected to said handling means, said mobile sides being located opposite said fixed sides when said mobile sides are in said first operating position, said upper fixed side face recess of each of said two fixed sides and said upper mobile side face recess of each of said two mobile sides defining a first pair of circular seats for receiving first end flanges of a first embossing roll when said mobile sides are in said first operating position, said lower fixed side face recess of each of said two fixed sides and said lower mobile side face recess of each of said two mobile sides defining a second pair of circular seats for receiving second end flanges of a second embossing roll when said mobile sides are in said first operating position, said mobile sides being located at a spaced location from said fixed sides when said mobile sides are in said second operating position, said upper fixed side recess of each of said fixed sides cooperating with a corresponding first semicircular closure flange to define a first upper pair of circular seats for receiving the first end flanges of the first embossing roll when said mobile sides are in said second operating position, said upper mobile side face recess of each of said mobile sides cooperating with a corresponding second semicircular closure flange to define a second upper pair of circular seats for receiving the second end flanges of the second embossing roll when said mobile sides are in said second operating position.

2. Embossing device according to claim 1, further comprising:

an embossing roller handling means for handling the embossing rolls, said embossing roller handling means comprising three driving shafts, two of said driving shafts having the respective axes passing through the center of the recesses in the fixed sides, the third said driving shaft having the respective axis at a preset distance from the other two of said driving shafts.

3. Embossing device according to claim 1, wherein said mobile sides are hinged to said fixed sides by means of hinges, each hinge having an axis parallel to the axis of the embossing rolls.

4. Embossing device according to claim 1, wherein said mobile sides are connected to two actuators, said actuators rotating said mobile sides in relation to the fixed sides.

5. Embossing device according to claim 1, further comprising:

a sizing unit supported by the fixed sides of the structure at the same height as the upper recesses of the fixed sides.

6. Embossing device according to claim 2, wherein said driving shafts are connectable to the rolls by means of corresponding laminar joints.

7. Embossing device according to claim 2, further comprising:

a selector to arrange only two driving shafts in a position such that said two driving shafts engage the rolls.

8. Embossing device according to claim 3, wherein said mobile sides are connected to two actuators, said actuators rotating said mobile sides in relation to the fixed sides about each axis of said hinges.

* * * * *